US012291874B2

(12) United States Patent
Osada et al.

(10) Patent No.: US 12,291,874 B2
(45) Date of Patent: May 6, 2025

(54) BUILDING AND FLASHING

(71) Applicant: Sekisui House, Ltd., Osaka (JP)

(72) Inventors: Toshiyuki Osada, Osaka (JP); Masaki Watanabe, Osaka (JP); Mitsuharu Yachi, Osaka (JP)

(73) Assignee: Sekisui House, Ltd., Osaka (JP)

( * ) Notice: Subject to any disclaimer, the term of this patent is extended or adjusted under 35 U.S.C. 154(b) by 167 days.

(21) Appl. No.: 18/019,681

(22) PCT Filed: Aug. 7, 2020

(86) PCT No.: PCT/JP2020/030318
§ 371 (c)(1),
(2) Date: Feb. 3, 2023

(87) PCT Pub. No.: WO2022/029991
PCT Pub. Date: Feb. 10, 2022

(65) Prior Publication Data
US 2023/0287685 A1 Sep. 14, 2023

(51) Int. Cl.
*E04D 13/147* (2006.01)
*E04D 3/40* (2006.01)
*E04D 13/04* (2006.01)

(52) U.S. Cl.
CPC ..... *E04D 13/1478* (2013.01); *E04D 3/40* (2013.01); *E04D 13/0445* (2013.01); *E04D 2013/045* (2013.01)

(58) Field of Classification Search
CPC ... E04D 3/40; E04D 13/1478; E04D 13/0445; E04D 2013/042
USPC ..... 52/58
See application file for complete search history.

(56) References Cited

U.S. PATENT DOCUMENTS 3,698,142 A * 10/1972 Theriault ..... E04D 13/1475 52/556
4,391,068 A * 7/1983 Kosar ..... E04D 13/1585 52/97
5,109,641 A * 5/1992 Halan ..... E04D 13/1478 52/62
5,519,969 A * 5/1996 Golba ..... E04D 13/1407 52/60
5,884,435 A * 3/1999 David ..... E04F 19/061 52/302.6

(Continued)

FOREIGN PATENT DOCUMENTS

EP 0 387 043 A1 9/1990
GB 2 138 466 A 10/1984

(Continued)

OTHER PUBLICATIONS

Australian Office Action dated Aug. 30, 2024, in connection with Australian Application No. 2020462129.

*Primary Examiner* — Paola Agudelo
(74) *Attorney, Agent, or Firm* — Wolf, Greenfield & Sacks, P.C.

(57) ABSTRACT

A building includes an outer wall, a roof arranged so as to be orthogonal to the outer wall and inclined with respect to the ground, and a flashing arranged at a boundary between the roof and the outer wall. The flashing includes an attachment configured to extend along the outer wall, a guide connected to the attachment and arranged above the roof, and a water draining portion arranged so as to intersect the attachment and the guide.

20 Claims, 5 Drawing Sheets

(56) References Cited

U.S. PATENT DOCUMENTS

| | | | | |
|---|---|---|---|---|
| 5,894,697 | A * | 4/1999 | Hunter | E04D 13/02 52/302.6 |
| 6,681,530 | B1 * | 1/2004 | Givens | E04D 13/1478 52/62 |
| 7,685,779 | B1 * | 3/2010 | Nelson | E04D 1/36 52/62 |
| 8,161,689 | B1 * | 4/2012 | Butzen | E06B 1/62 52/58 |
| 2003/0046878 | A1 * | 3/2003 | Zdeb | E04D 13/1478 52/272 |
| 2004/0016201 | A1 * | 1/2004 | Folkersen | E04D 12/002 52/746.11 |
| 2005/0086873 | A1 * | 4/2005 | Mares | E04D 13/1478 52/58 |
| 2005/0183345 | A1 * | 8/2005 | Allen | E04D 13/1478 52/58 |
| 2016/0376791 | A1 * | 12/2016 | Givens | E04D 13/1478 52/62 |
| 2019/0284814 | A1 * | 9/2019 | Folkersen | E04D 13/1478 |
| 2020/0378127 | A1 * | 12/2020 | Folkersen | E04D 13/0459 |
| 2022/0009196 | A1 * | 1/2022 | Klein | B32B 3/14 |

FOREIGN PATENT DOCUMENTS

| | | | |
|---|---|---|---|
| GB | 2 189 527 | A | 10/1987 |
| GB | 2 508 650 | A | 6/2014 |
| JP | S60-16176 | A | 1/1985 |
| JP | S60-16176 | Y2 | 5/1985 |
| JP | 2521076 | Y2 | 12/1996 |

* cited by examiner

BUILDING AND FLASHING

CROSS REFERENCE TO RELATED APPLICATIONS

This Application is a national stage filing under 35 U.S.C. 371 of International Patent Application Serial No. PCT/JP2020/030318, filed Aug. 7, 2020, entitled "BUILDING AND FLASHING". The entire content of this application is incorporated herein by reference in its entirety.

TECHNICAL FIELD

The present invention relates to a building and a flashing.

BACKGROUND

Patent Literature 1 discloses a flashing arranged on a building. The flashing includes a sheet arranged on a wall and a sheet arranged on a roof.

CITATION LIST

Patent Literature

Patent Literature 1: U.K. Patent Application Publication No. 2508650

SUMMARY OF INVENTION

Technical Problem

Building materials tend to deteriorate due to rainwater in the vicinity of the boundary between the outer wall and the roof. This may cause water penetration. For example, the building materials deteriorate due to the flow of rainwater at the lower end of the boundary. In this respect, there is room for improvement in a flashing. Thus, a building and a flashing capable of preventing deterioration of building materials that result from the flow of rainwater are provided.

Solution to Problem

A building that solves the above problem includes an outer wall, a roof arranged so as to be orthogonal to the outer wall and inclined with respect to the ground, and a flashing arranged at a boundary between the roof and the outer wall. The flashing includes an attachment configured to extend along the outer wall, a guide connected to the attachment and arranged above the roof, and a water draining portion arranged so as to intersect the attachment and the guide.

In this configuration, the rainwater flowing on the boundary between the outer wall and the roof is drained by the water draining portion. This reduces the amount of the rainwater that flows in the vicinity of the boundary between the outer wall and the roof and reaches the lower end of that boundary. Accordingly, the building materials are prevented from deteriorating in the vicinity of the lower end of the boundary.

(2) In the building according to (1), the outer wall includes a wall body and an exterior panel spaced apart from the wall body by a gap. The attachment is attached to the wall body. The guide includes an inner guide arranged below a lower end face of the exterior panel and an outer guide arranged outside of the exterior panel. The inner guide is arranged so as to produce a gap between the inner guide and the lower end face of the exterior panel.

In this configuration, the rainwater entering the gap, which is between the wall body and the exterior panel, is guided from the attachment through the inner guide to the outer guide and then guided to the roof. Accordingly, the rainwater entering the gap, which is between the wall body and the exterior panel, is discharged out of the exterior panel. This prevents the outer wall from deteriorating.

(3) In the building according to (2), the water draining portion includes a barrier. The barrier is arranged so as to connect to a lower end of the attachment and a lower end of the inner guide, and is arranged in the gap between the wall body and the exterior panel.

In this configuration, the rainwater flowing along the inner guide in the gap, which is between the wall body and the exterior panel, is blocked by the barrier and drained out of the exterior panel. This reduces the amount of the rainwater that reaches the lower end on the boundary between the wall body and the roof. Accordingly, the building materials in the vicinity of the lower end of that boundary are prevented from deteriorating.

(4) In the building according to (3), the water draining portion further includes an extension barrier. The extension barrier is configured to extend from the barrier and is arranged such that at least part of the extension barrier overlaps an end face or a cross-section of the exterior panel.

Without the extension barrier, the amount of the rainwater that is not discharged out of the exterior panel would become larger. In the above configuration, the rainwater blocked by the barrier is discharged by the extension barrier out of the exterior panel. This reduces the amount of the rainwater that is not discharged out of the exterior panel.

(5) In the building according to (4), the exterior panel includes a notch in which the exterior barrier is arranged. The extension barrier is arranged in the notch of the exterior panel.

A configuration may be employed in which the exterior panel is divided into pieces and the divided exterior panels are arranged so as to sandwich the extension barrier. However, this may lower the aesthetic appeal of the exterior panel. In this regard, the exterior panel only includes the notch. Thus, the aesthetic appeal is prevented from being lowered.

(6) In the building according to (5), the extension barrier includes a seal that seals at least part of the notch. This configuration reduces the amount of rainwater entering the exterior panel from the notch.

(7) The building according to (5) or (6), the water draining portion and the notch are located closer to a ridge of the roof than to a lower end of the outer guide.

The notch may lower the aesthetic appeal of the exterior panel. In a case where the notch is arranged in the vicinity of the lower end of the roof, the notch may be seen when the roof of the building is looked at from below. In this regard, the above configuration makes the notch hard to be seen. Thus, the aesthetic appeal of the building is improved.

(8) In the building according to any one of (2) to (7), the outer guide includes a main guide connected to the inner guide and an extension guide extending downward from the main guide. The extension guide includes a guide side portion arranged so as to extend along a gap below the exterior panel. This configuration prevents the rainwater that flows to the flashing from entering the exterior panel.

(9) In the building according to any one of (1) to (8), the flashing includes multiple members.

This configuration allows the flashing to be formed using components each having a simple structure. Thus, the flashing is manufactured more easily.

(10) A flashing that solves the above problem is attached to a building. The building includes a roof arranged so as to be orthogonal to the outer wall and inclined with respect to the ground. The flashing includes an attachment arranged at a boundary between the roof and the outer wall and configured to extend along the outer wall, a guide connected to the attachment and arranged on the roof, and a water draining portion arranged so as to intersect the attachment and the guide.

In this configuration, the rainwater flowing on the boundary between the outer wall and the roof is drained by the water draining portion. This reduces the amount of the rainwater that flows in the vicinity of the boundary between the outer wall and the roof and reaches the lower end of that boundary. Accordingly, the building materials are prevented from deteriorating in the vicinity of the boundary.

Advantageous Effects of Invention

The building and the flashing prevent deterioration of building materials that result from the flow of rainwater.

DESCRIPTION OF EMBODIMENTS

A building will now be described with reference to FIGS. 1 to 8.

Figure 1:
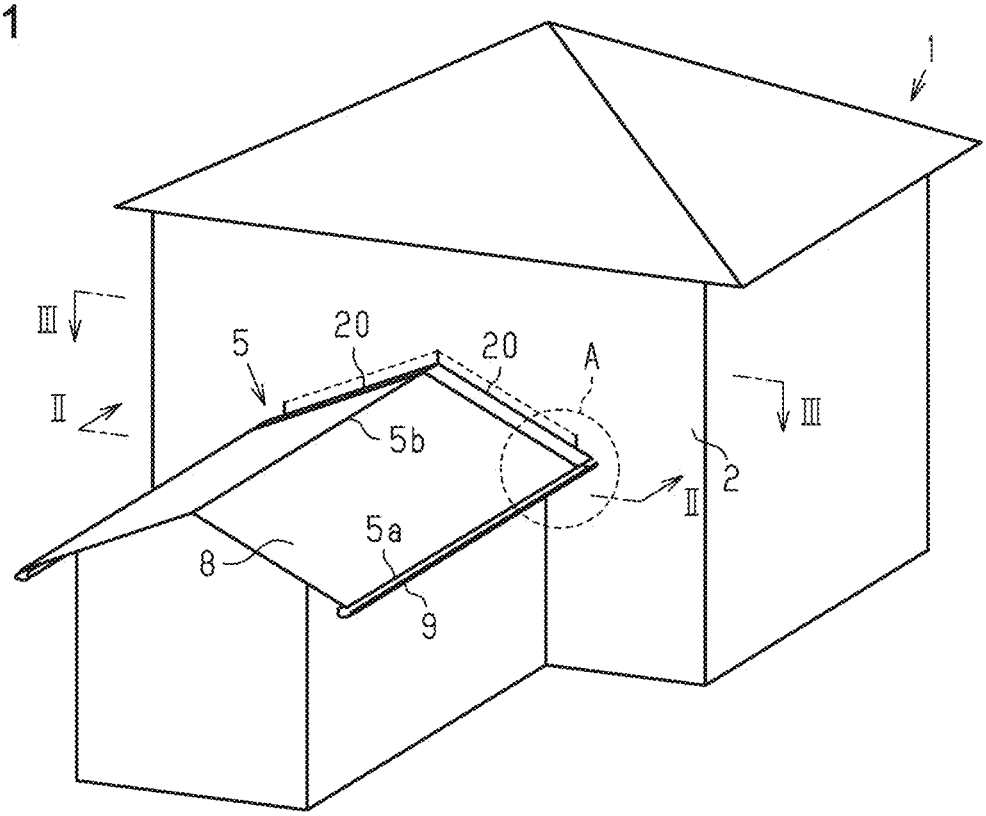
FIG. 1 is a diagram schematically showing a building.

As shown in FIG. 1, a building 1 includes an outer wall 2 and a roof 5. The roof 5 is arranged so as to be orthogonal to the outer wall 2 and inclined with respect to the ground.

Figure 2:
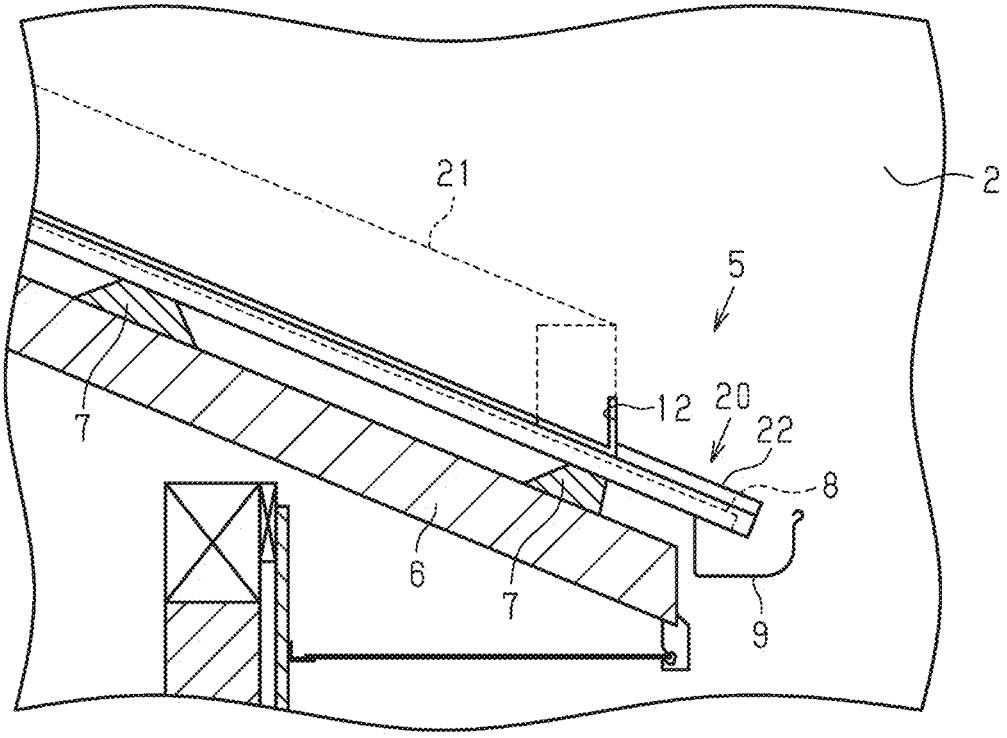
FIG. 2 is partial cross-sectional view showing the building taken along line II-II in FIG. 1.

As shown in FIG. 2, the roof 5 includes a rafter 6, a receiving part 7 arranged so as to intersect the rafter 6, and a roof member 8 arranged on the receiving part 7. At the lower end of the roof 5, a rain gutter 9 is arranged. The roof 5 of the present embodiment may also be a gable roof.

The boundary between the outer wall 2 and the roof 5 is diagonally inclined downward. In such a building 1, rainwater R striking the outer wall 2 flows down on the outer wall 2 and then flows along the boundary between the outer wall 2 and the roof 5. In heavy rains, a large amount of the rainwater R flows to the boundary between the outer wall 2 and the roof 5 so that building materials at the lower end of the boundary are eroded by the rainwater R. Further, the building materials arranged in the vicinity of the boundary between the outer wall 2 and the roof 5 may be gradually deteriorated by winds and rain over a long period of time. For this reason, as will be described later, a flashing 20 is arranged on the building 1 at the boundary between the outer wall 2 and the roof 5.

Figure 3:
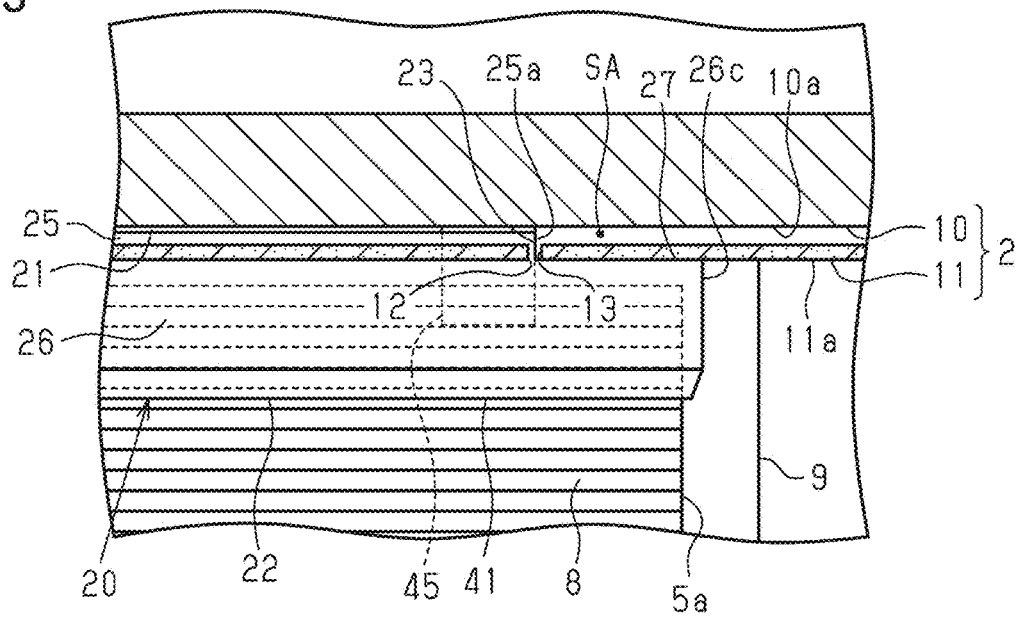
FIG. 3 is partial cross-sectional view showing the building taken along line III-III in FIG. 1.

As shown in FIG. 3, the outer wall 2 includes a wall body 10 and an exterior panel 11. The wall body 10 is covered by multiple exterior panels 11 using furring strips. The exterior panel 11 is spaced apart from the wall body 10 by a gap SA. The gap SA between the wall body 10 and the exterior panel 11 is used as an air passage for ventilation. The wall body 10 includes an outer surface 10*a* that is covered by a waterproof sheet 15 (see FIG. 5).

The outer wall 2 is arranged so as to intersect the roof 5. In the outer wall 2, the lower end of the exterior panel 11 attached to the upper side of the roof 5 is cut off in conformance with the inclination of the roof 5. The lower end of the exterior panel 11, which is attached to the upper side of the roof 5, includes a notch 12. The notch 12 is used as a slit through which an extension barrier 32 (described later) of the flashing 20 is inserted. The notch 12 is located at the same position as the extension barrier 32 of a water draining portion 23 (described later). For example, the notch 12 is located closer to the ridge 5*b* of the roof 5 than to the lower end of an outer guide 26.

As shown in FIG. 1, the building 1 includes the flashing 20. The flashing 20 guides, to the roof 5 and the rain gutter 9, the rainwater R flowing down on the outer wall 2. The flashing 20 is located at the boundary between the roof 5 and the outer wall 2.

Figure 4:
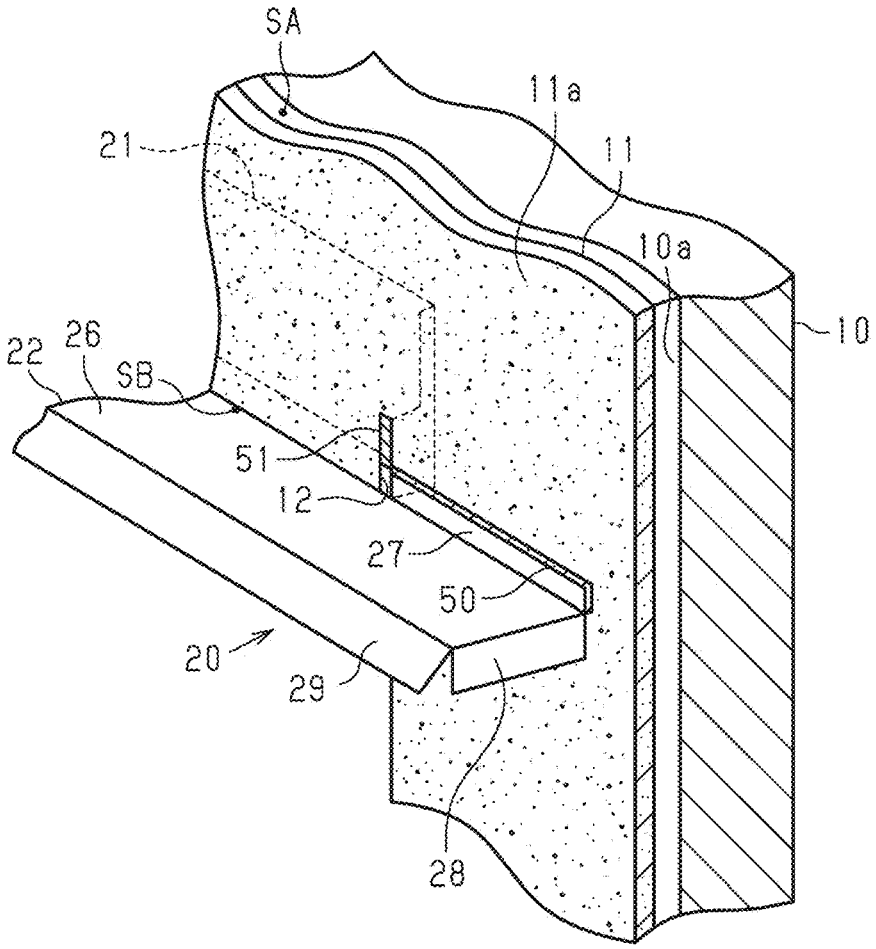
FIG. 4 is an enlarged view showing section A in FIG. 1.
Figure 5:
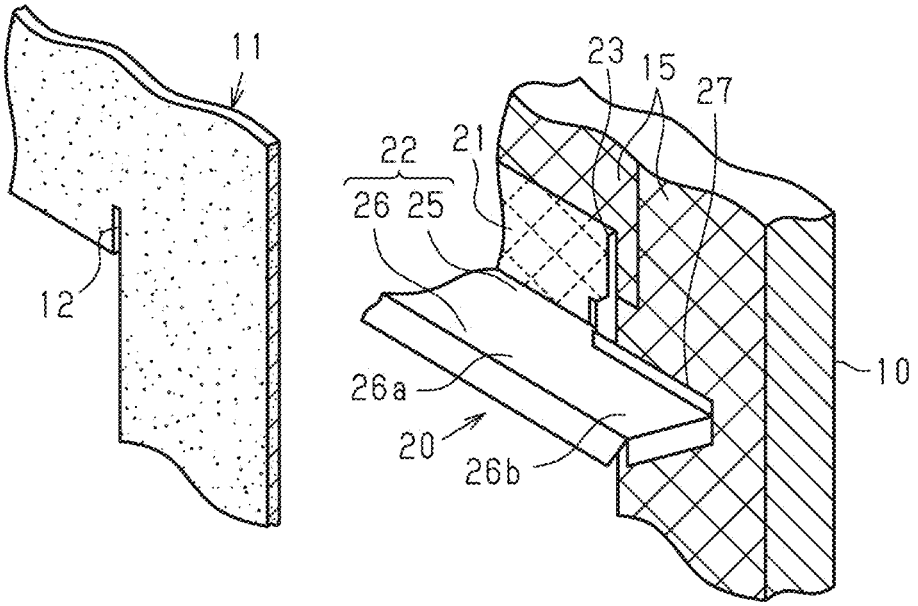
FIG. 5 is an exploded view showing a portion that includes the flashing.
Figure 6:
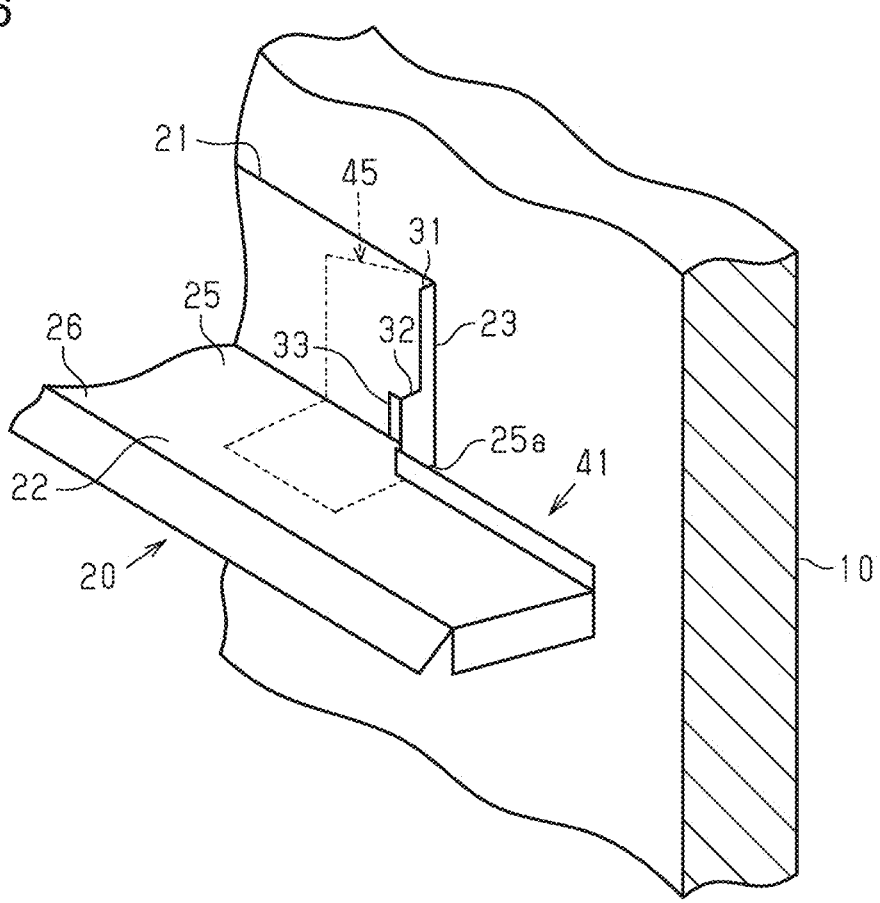
FIG. 6 is an exploded view showing the portion that includes the flashing, with the exterior panel and the waterproof sheet omitted.

As shown in FIGS. 4, 5, and 6, the flashing 20 includes an attachment 21, a guide 22, and the water draining portion 23.

The attachment 21 is configured to extend along the outer wall 2.

More specifically, in the present embodiment, the attachment 21 is configured to extend in parallel to the roof 5 in side view (see FIG. 2) and configured to extend along the wall body 10 in plan view (see FIG. 3). The attachment 21 is attached to the wall body 10. Preferably, the attachment 21 is attached to the wall body 10, with the waterproof sheet 15 located therebetween. Preferably, the attachment 21 is attached to the wall body 10 so as to be in close contact with the wall body 10.

As shown in FIG. 4, the guide 22 connects to the attachment 21. In an attached state where the flashing 20 is attached to the outer wall 2, the guide 22 is configured to intersect the wall body 10. The guide 22 is configured to extend along the roof 5 in side view (see FIG. 2) and configured to extend in parallel to the wall body 10 in plan view (see FIG. 3). Further, the guide 22 is arranged on the roof 5. The guide 22 guides the rainwater R to a portion of the roof 5 located relatively far from the boundary between the outer wall 2 and the roof 5. This prevents the rainwater R from flowing to the boundary in a concentrated manner.

As shown in FIG. 5, the guide 22 includes an inner guide 25 and the outer guide 26. The inner guide 25 is located below the lower end face of the exterior panel 11. The inner guide 25 is spaced apart from the lower end of the exterior panel 11. A gap SB is formed between the upper surface of the inner guide 25 and the lower end face of the exterior panel 11 (see FIG. 4). The gap SB connects to the gap SA, which is between the wall body 10 and the exterior panel 11. The gap SB is a ventilation hole and is also a drain hole for the rainwater R.

The outer guide 26 is located outside of the exterior panel 11. The outer guide 26 is located above the roof member 8. The outer guide 26 is longer than the inner guide 25. More specifically, the outer guide 26 includes a main guide 26*a* connecting to the inner guide 25 and an extension guide 26*b* extending downward from the main guide 26*a*. In the attached state, where the flashing 20 is attached to the outer wall 2, a lower end 25*a* of the inner guide 25 is located closer to the ridge 5*b* than to eaves 5*a* of the roof 5. A lower end

26*c* of the outer guide 26 is located farther from the ridge 5*b* than from the eaves 5*a* of the roof 5 (see FIG. 3).

The extension guide 26*b* further includes a guide side portion 27. The guide side portion 27 is arranged on the extension guide 26*b* along the gap SB, which is located below the exterior panel 11. Preferably, the guide side portion 27 covers the gap SB, which is located below the exterior panel 11. In the attached state, where the flashing 20 is attached to the outer wall 2, a sealing resin 50 is used to seal the gap formed between an end edge of the guide side portion 27 and an outer surface 11*a* of the exterior panel 11 (see FIG. 4).

The extension guide 26*b* further includes a guide lower end 28. The guide lower end 28 is located at the lower end of the extension guide 26*b*. The guide lower end 28 is configured to be inclined downward from the lower end of the extension guide 26*b* such that the lower end of the guide lower end 28 faces the rain gutter 9.

The outer guide 26 includes a guide inclined portion 29. In the outer guide 26, the guide inclined portion 29 is located opposite the attachment 21 and the guide side portion 27. The guide inclined portion 29 is inclined toward a groove with respect to the roof member 8.

The water draining portion 23 will now be described with reference to FIGS. 3, 5, and 6.

As shown in FIG. 3, the water draining portion 23 is located closer to the ridge 5*b* of the roof 5 than to the lower end 26*c* of the outer guide 26. As shown in FIG. 6, the water draining portion 23 is arranged so as to intersect the attachment 21 and the guide 22. The water draining portion 23 includes a barrier 31. Preferably, the water draining portion 23 includes the extension barrier 32.

The barrier 31 is arranged so as to connect to the lower end of the attachment 21 and the lower end 25*a* of the inner guide 25, and is located in the gap SA, which is between the wall body 10 and the exterior panel 11. The barrier 31 blocks the rainwater R flowing through the gap SA, which is between the wall body 10 and the exterior panel 11, to drain the rainwater R out of the exterior panel 11.

The extension barrier 32 is configured to extend from the barrier 31. For example, the length of the extension barrier 32 in the up-down direction is smaller than the length of the barrier 31 in the up-down direction. This allows the length of the notch 12 (described later) to be shorter. The extension barrier 32 is arranged such that at least part of the extension barrier 32 overlaps the end face or a cross-section 13 of the exterior panel 11. In the present embodiment, the extension barrier 32 is arranged in the notch 12 of the exterior panel 11 (see FIG. 3).

Further, the extension barrier 32 includes a seal 33. The seal 33 seals at least part of the notch 12 of the exterior panel 11. The seal 33 is arranged so as to be orthogonal to the extension barrier 32.

Figure 7:
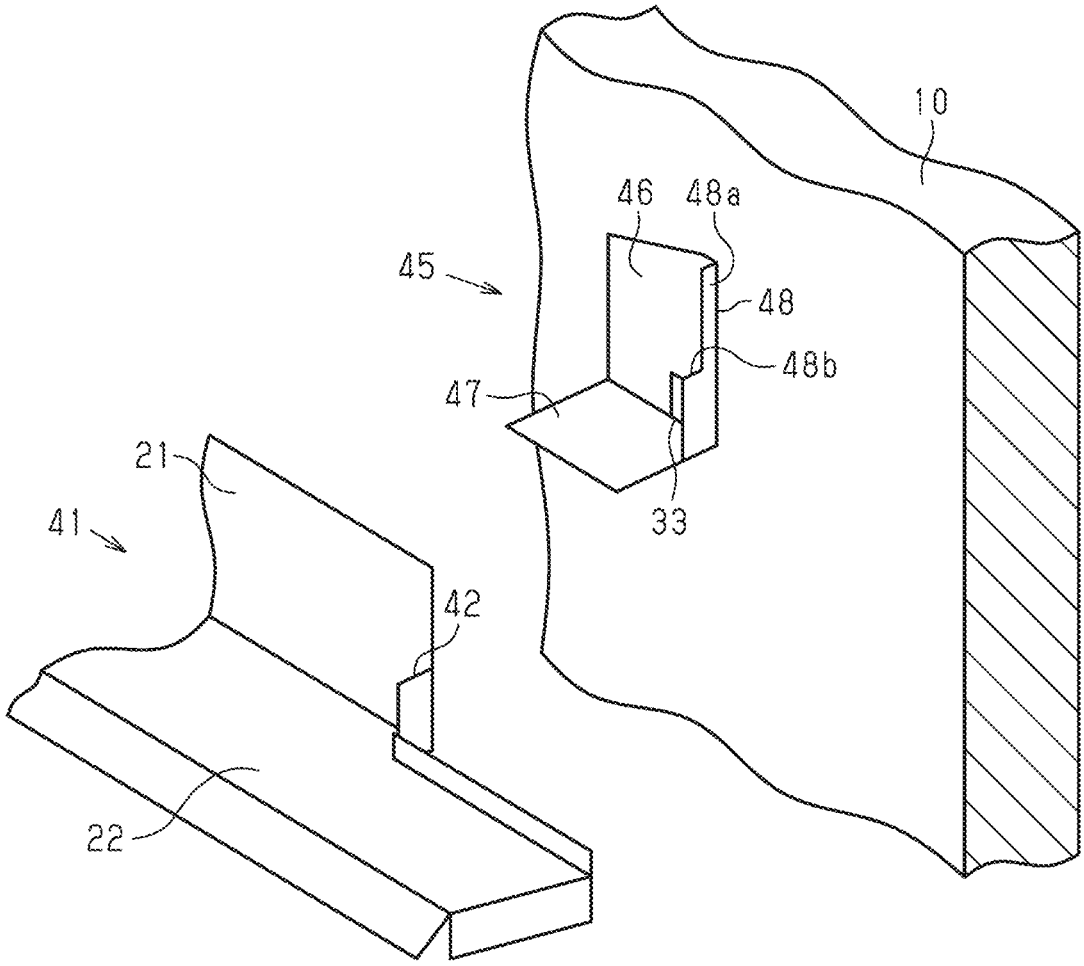
FIG. 7 is an exploded view showing the flashing.

As shown in FIG. 7, the flashing 20 includes multiple members. In the present embodiment, the flashing 20 includes a flashing body 41 and a flashing support 45. The flashing body 41 is formed using a plastic sheet. The flashing support 45 is made of sheet metal.

The flashing body 41 includes the attachment 21, the guide 22, and a water draining cover 42. In an example, the flashing body 41 is formed by bending a waterproof sheet. In another example, the flashing body 41 is formed through die molding.

The flashing support 45 includes an attachment 46, a support 47, and a water draining body 48. The attachment 46 of the flashing support 45 is fixed to the wall body 10 of the outer wall 2. The support 47 of the flashing support 45 supports the lower end of the flashing body 41. The water draining body 48 includes a barrier body 48*a*, an extension barrier body 48*b*, and the seal 33. The seal 33 is configured to extend from the extension barrier body 48*b* and be bent with respect to the extension barrier body 48*b*.

The water draining portion 23 is formed by overlapping the water draining cover 42 on the water draining body 48. The water draining cover 42 overlaps part of the barrier body 48*a* of the water draining body 48 and overlaps the extension barrier body 48*b*.

The flashing support 45 is fixed to the wall body 10 of the outer wall 2. In construction of the building 1, the flashing support 45 is attached to the wall body 10 of the outer wall 2 before attachment of the roof member 8. Subsequently, the roof member 8 is arranged, the waterproof sheet 15 is stretched over the wall body 10, and the flashing body 41 is attached to the wall body 10 with the attachment 21 located therebetween (see FIG. 5). During the attaching, the guide 22 of the flashing body 41 is arranged above the roof member 8. The water draining cover 42 of the flashing body 41 is overlapped on the water draining body 48 of the flashing support 45. Then, the exterior panel 11 is attached to the wall body 10 using furring strips. At this time, the exterior panel 11 is attached to the wall body 10 such that the water draining portion 23 of the flashing 20 is arranged in the notch 12 of the exterior panel 11. Subsequently, the upper part of the notch 12 is sealed using a sealing resin 51 (see FIG. 4). The lower part of the notch 12 is formed as a drain for the rainwater R, without being sealed. The guide side portion 27 of the flashing body 41 is arranged along the outer surface 11*a* of the exterior panel 11. In addition, as described above, the sealing resin 50 is used to seal the gap formed between the end edge of the guide side portion 27 and the outer surface 11*a* of the exterior panel 11 (see FIG. 4). This prevents the rainwater R flowing along the guide side portion 27 from entering the exterior panel 11.

Figure 8:
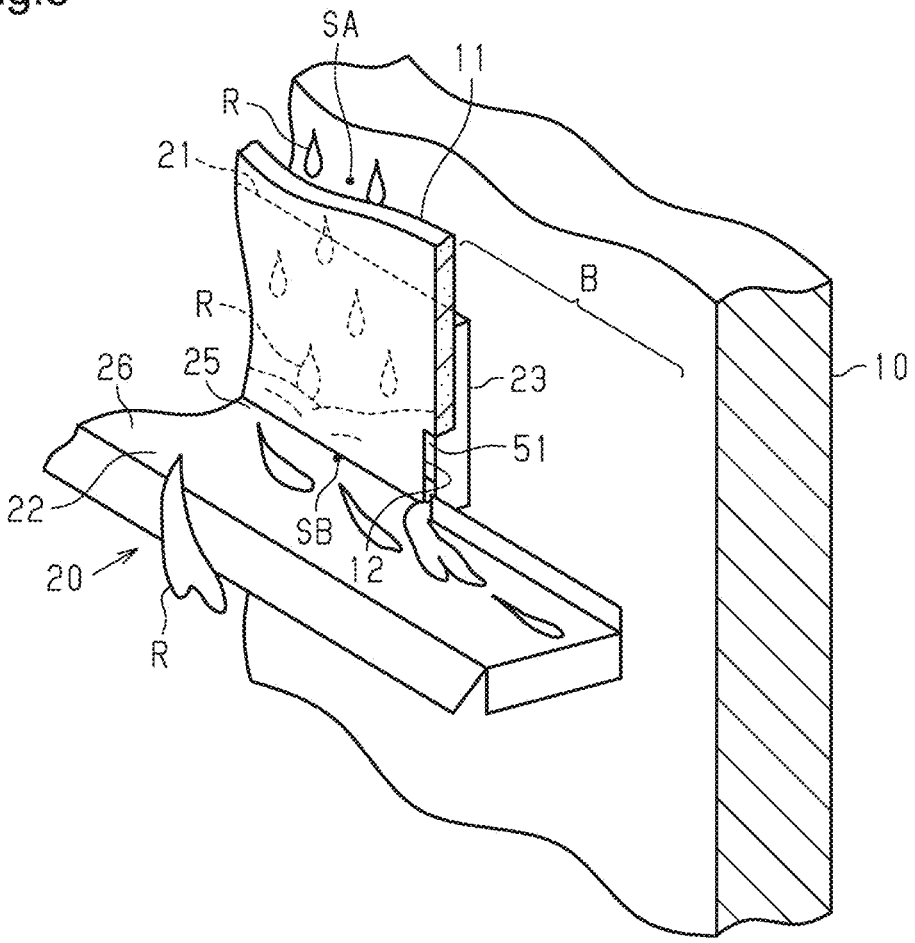
FIG. 8 is a diagram illustrating how water is drained by the flashing.

The operation of the present embodiment will now be described with reference to FIG. 8. In the exterior panel 11 shown in FIG. 8, the section indicated by B is omitted. In FIG. 8, the roof 5 is not shown.

When it rains, the rainwater R flows down on the outer surface 11*a* of the exterior panel 11 of the outer wall 2. The rainwater R that has reached the lower end of the panel of the outer wall 2 is received by the flashing 20 and guided downward. The flashing 20 causes the rainwater R to flow to a portion that is separated from the outer wall 2 below or on the roof 5. Part of the rainwater R enters the exterior panel 11 and the gap SA. When the rain gets heavy, a larger amount of water enters the gap SA, which is between the exterior panel 11 and the wall body 10. The rainwater R in the gap SA flows downward and is received by the flashing 20. The rainwater R is guided to the flashing 20. The rainwater R flows out of the exterior panel 11 through the gap SB, which is between the upper surface of the inner guide 25 of the flashing 20 and the lower end face of the exterior panel 11. Further, the rainwater R reaches a portion of the roof 5 that is separated from the outer wall 2. In contrast, when the rainwater R that remains in the gap SB flows downward to reach the water draining portion 23 of the flashing 20, the rainwater R is blocked by the water draining portion 23 and flows out of the exterior panel 11. Accordingly, the rainwater R that enters the gap SA, which is between the exterior panel 11 and the wall body 10, is discharged out of the exterior panel 11.

The advantages of the present embodiment will now be described.

(1) The building 1 includes the roof 5, which is arranged so as to be orthogonal to the outer wall 2 and inclined with respect to the ground. In the building 1, the flashing 20 is arranged at the boundary between the roof 5 and the outer wall 2. The flashing 20 includes the attachment 21, the guide 22, which is arranged above the roof 5, and the water draining portion 23, which is arranged so as to intersect the attachment 21 and the guide 22.

In this configuration, the rainwater R flowing on the boundary between the outer wall 2 and the roof 5 is drained by the water draining portion 23. This reduces the amount of the rainwater R that flows in the vicinity of the boundary between the outer wall 2 and the roof 5 and reaches the lower end of that boundary. Accordingly, the building materials are prevented from deteriorating in the vicinity of the lower end of the boundary.

(2) Preferably, the guide 22 includes the inner guide 25, which is located below the lower end face of the exterior panel 11, and the outer guide 26, which is arranged outside of the exterior panel 11. The inner guide 25 is arranged so as to produce the gap SB, which is between the inner guide 25 and the lower end face of the exterior panel 11.

In this configuration, the rainwater R entering the gap SA, which is between the wall body 10 and the exterior panel 11, is guided from the attachment 21 through the inner guide 25 to the outer guide 26 and then guided to the roof 5. Accordingly, the rainwater R entering the gap SA, which is between the wall body 10 and the exterior panel 11, is discharged out of the exterior panel 11. This prevents the outer wall 2 from deteriorating.

(3) The water draining portion 23 includes the barrier 31. The barrier 31 is arranged in the gap SA between the wall body 10 and the exterior panel 11.

In this configuration, the rainwater R flowing along the inner guide 25 in the gap SA, which is between the wall body 10 and the exterior panel 11, is blocked by the barrier 31 and drained out of the exterior panel 11. This reduces the amount of the rainwater R that reaches the lower end on the boundary between the wall body 10 and the roof 5.

Accordingly, the building materials in the vicinity of the lower end of that boundary are prevented from deteriorating.

(4) The water draining portion 23 includes the extension barrier 32. The extension barrier 32 is configured to extend from the barrier 31. Further, the extension barrier 32 is arranged such that at least part of the extension barrier 32 overlaps the end face or the cross-section 13 of the exterior panel 11. In the present embodiment, the extension barrier 32 overlaps the cross-section 13 of the exterior panel 11 in the notch 12.

Without the extension barrier 32, the amount of the rainwater R that is not discharged out of the exterior panel 11 would become larger. In the above configuration, the rainwater R blocked by the barrier 31 is discharged by the extension barrier 32 out of the exterior panel 11. This reduces the amount of the rainwater R that is not discharged out of the exterior panel 11.

(5) The exterior panel 11 includes the notch 12, in which the extension barrier 32 is arranged. The extension barrier 32 is arranged in the notch 12 of the exterior panel 11.

A configuration may be employed in which the exterior panel 11 is divided into pieces and the divided exterior panels 11 are arranged so as to sandwich the extension barrier 32. However, this may lower the aesthetic appeal of the exterior panel 11. In this regard, the exterior panel 11 only includes the notch 12. Thus, the aesthetic appeal is prevented from being lowered.

(6) The extension barrier 32 includes the seal 33, which seals at least part of the notch 12. This configuration reduces the amount of rainwater entering the exterior panel 11 from the notch 12.

(7) The water draining portion 23 and the notch 12 are located closer to the ridge **5*b* of the roof 5 than to the lower end 26*c* of the outer guide 26**.

The notch 12 may lower the aesthetic appeal of the exterior panel 11. In a case where the notch 12 is arranged in the vicinity of the lower end of the roof 5, the notch may be seen when the roof 5 of the building 1 is looked at from below. In this regard, the above configuration makes the notch 12 hard to be seen. Thus, the aesthetic appeal of the building 1 is improved.

(8) The outer guide 26 includes the main guide **26*a*, which connects to the inner guide 25, and the extension guide 26*b*, which extends downward from the main guide 26*a*. The extension guide 26*b* includes the guide side portion 27, which is arranged so as to extend along the gap SB below the exterior panel 11. This configuration prevents the rainwater R that flows to the flashing 20 from entering the exterior panel 11**.

(9) The flashing 20 includes multiple members. This configuration allows the flashing 20 to be formed using components each having a simple structure. Thus, the flashing 20 is manufactured more easily.

(10) The flashing 20 is attached to the building 1. The building 1 includes the roof 5, which is arranged so as to be orthogonal to the outer wall 2 and inclined with respect to the ground. The flashing 20 is located at the boundary between the roof 5 and the outer wall 2. The flashing 20 includes the water draining portion 23, which is arranged so as to intersect the attachment 21 and the guide 22.

In this configuration, the rainwater R flowing on the boundary between the outer wall 2 and the roof 5 is drained by the water draining portion 23. This reduces the amount of the rainwater R that flows in the vicinity of the boundary between the outer wall 2 and the roof 5 and reaches the lower end of that boundary. Accordingly, the building materials are prevented from deteriorating in the vicinity of the boundary.

Modifications

The above embodiment exemplifies, without any intention to limit, an applicable form of the building 1. The building 1 exemplified in the embodiment can take a form different from that illustrated in the embodiment. For example, some of the components of the embodiment may be replaced, changed, or omitted. Alternatively, another component may be added to the embodiment. Modifications of the embodiment will now be described.

In the present embodiment, the water draining portion 23 is located closer to the ridge **5*b* of the roof 5 than to the lower end 26*c* of the outer guide 26. Instead, for example, the water draining portion may be located at the same position as the lower end 26*c* of the outer guide 26**.

The structure of the water draining portion 23 is not limited to the above example. In the present embodiment, the length of the extension barrier 32 in the up-down direction is smaller than the length of the barrier 31 in the up-down direction. Instead, for example, the extension barrier 32 may have the same length as the barrier 31. The extension barrier 32 may be omitted.

REFERENCE SIGNS LIST

SA) Gap; SB) Gap; 1) Building; 2) Outer Wall; 5) Roof; **5*b*) Ridge; 10) Wall Body; 11) Exterior Panel; 12**)

Notch; 13) Cross-section; 20) Flashing; 21) Attachment; 22) Guide; 23) Water Draining Portion; 31) Barrier; 32) Extension Barrier; 33) Seal; 46) Attachment

The invention claimed is:

1. A building, comprising:
an outer wall;
a roof arranged so as to be orthogonal to the outer wall and inclined with respect to the ground; and
a flashing arranged at a boundary between the roof and the outer wall, wherein
the outer wall includes:
a wall body; and
an exterior panel spaced apart from the wall body by a gap,
the flashing includes:
an attachment configured to extend along the outer wall;
a guide connected to the attachment and arranged on the roof; and
a water draining portion arranged so as to intersect the attachment and the guide:
the attachment is attached to the wall body,
the guide includes:
an inner guide arranged below a lower end face of the exterior panel; and
an outer guide arranged outside of the exterior panel,
the inner guide is arranged so as to produce a gap between the inner guide and the lower end face of the exterior panel,
the water draining portion includes a barrier, and
the barrier is arranged so as to connect to a lower end of the attachment and a lower end of the inner guide, and is arranged in the gap between the wall body and the exterior panel.

2. The building according to claim 1, wherein the flashing includes multiple members.

3. The building according to claim 1, wherein the extension barrier includes a seal that seals at least part of the notch.

4. The building according to claim 1, wherein the water draining portion and the notch are located closer to a ridge of the roof than to a lower end of the outer guide.

5. A building, comprising:
an outer wall;
a roof arranged so as to be orthogonal to the outer wall and inclined with respect to the ground; and
a flashing arranged at a boundary between the roof and the outer wall, wherein
the outer wall includes:
a wall body; and
an exterior panel spaced apart from the wall body by a gap,
the flashing includes:
an attachment configured to extend along the outer wall;
a guide connected to the attachment and arranged on the roof; and
a water draining portion arranged so as to intersect the attachment and the guide,
the attachment is attached to the wall body,
the guide includes:
an inner guide arranged below a lower end face of the exterior panel; and
an outer guide arranged outside of the exterior panel,
the inner guide is arranged so as to produce a gap between the inner guide and the lower end face of the exterior panel,
the outer guide includes:
a main guide connected to the inner guide; and
an extension guide extending downward from the main guide, and
the extension guide includes a guide side portion extending in a direction in which the gap below the exterior panel extends.

6. The building according to claim 5, wherein
the water draining portion includes a barrier, and
the barrier is arranged so as to connect to a lower end of the attachment and a lower end of the inner guide, and is arranged in the gap between the wall body and the exterior panel.

7. The building according to claim 5, wherein the flashing includes multiple members.

8. The building according to claim 6, wherein
the water draining portion further includes an extension barrier, and
the extension barrier is configured to extend from the barrier and is arranged such that at least part of the extension barrier overlaps an end face or a cross-section of the exterior panel.

9. The building according to claim 6, wherein the flashing includes multiple members.

10. The building according to claim 8, wherein
the exterior panel includes a notch in which the extension barrier is arranged, and
the extension barrier is arranged in the notch of the exterior panel.

11. The building according to claim 8, wherein the flashing includes multiple members.

12. The building according to claim 10, wherein the extension barrier includes a seal that seals at least part of the notch.

13. The building according to claim 10, wherein the water draining portion and the notch are located closer to a ridge of the roof than to a lower end of the outer guide.

14. The building according to claim 12, wherein the water draining portion and the notch are located closer to a ridge of the roof than to a lower end of the outer guide.

15. A flashing attached to a building, the building including a roof arranged so as to be orthogonal to an outer wall and inclined with respect to the ground, the flashing comprising:
an attachment and configured to extend along the outer wall;
a guide connected to the attachment and arranged on the roof; and
a water draining portion arranged so as to intersect the attachment and the guide, wherein
the outer wall includes: a wall body; and an exterior panel spaced apart from the wall body by a gap,
the flashing is arranged at a boundary between the roof and the outer wall,
the attachment is attached to the wall body,
the guide includes:
an inner guide arranged below a lower end face of the exterior panel; and
an outer guide arranged outside of the exterior panel,
the inner guide is arranged so as to produce a gap between the inner guide and the lower end face of the exterior panel,
the water draining portion includes a barrier, and the barrier is arranged so as to connect to a lower end of the attachment and a lower end of the inner guide, and is arranged in the gap between the wall body and the exterior panel.

16. A building, comprising:

an outer wall;

a roof arranged so as to be orthogonal to the outer wall and inclined with respect to the ground; and a flashing arranged at a boundary between the roof and the outer wall, wherein the outer wall includes:

a wall body; and an exterior panel spaced apart from the wall body by a gap, the exterior panel includes a notch, the flashing includes:

an attachment configured to extend along the outer wall;

a guide connected to the attachment and arranged on the roof; and a water draining portion arranged so as to intersect the attachment and the guide, the attachment is attached to the wall body, the guide includes:

an inner guide arranged below a lower end face of the exterior panel; and an outer guide arranged outside of the exterior panel, the inner guide is arranged so as to produce a gap between the inner guide and the lower end face of the exterior panel, the water draining portion includes a barrier and an extension barrier, the barrier is arranged so as to connect to a lower end of the attachment and a lower end of the inner guide, and is arranged in the gap between the wall body and the exterior panel, and the extension barrier is configured to extend from the barrier and is arranged in the notch of the exterior panel.

17. The building according to claim 16, wherein the extension barrier includes a seal that seals at least part of the notch.

18. The building according to claim 16, wherein the flashing includes multiple members.

19. A flashing attached to a building, the building including a roof arranged so as to be orthogonal to an outer wall and inclined with respect to the ground, the flashing comprising:

an attachment configured to extend along the outer wall;

a guide connected to the attachment and arranged on the roof; and a water draining portion arranged so as to intersect the attachment and the guide, wherein the outer wall includes: a wall body; and an exterior panel spaced apart from the wall body by a gap, the exterior panel including a notch, the flashing is arranged at a boundary between the roof and the outer wall, the attachment is attached to the wall body, the guide includes:

an inner guide arranged below a lower end face of the exterior panel; and an outer guide arranged outside of the exterior panel, the inner guide is arranged so as to produce a gap between the inner guide and the lower end face of the exterior panel, the water draining portion includes a barrier and an extension barrier, the barrier is arranged so as to connect to a lower end of the attachment and a lower end of the inner guide, and is arranged in the gap between the wall body and the exterior panel, and the extension barrier is configured to extend from the barrier and is arranged in the notch of the exterior panel.

20. A flashing attached to a building, the building including a roof arranged so as to be orthogonal to an outer wall and inclined with respect to the ground, the flashing comprising:

an attachment configured to extend along the outer wall;

a guide connected to the attachment and arranged on the roof; and a water draining portion arranged so as to intersect the attachment and the guide, wherein the outer wall includes: a wall body; and an exterior panel spaced apart from the wall body by a gap, the flashing is arranged at a boundary between the roof and the outer wall, the attachment is attached to the wall body, the guide includes:

an inner guide arranged below a lower end face of the exterior panel; and an outer guide arranged outside of the exterior panel, the inner guide is arranged so as to produce a gap between the inner guide and the lower end face of the exterior panel, the outer guide includes:

a main guide connected to the inner guide; and an extension guide extending downward from the main guide, and the extension guide includes a guide side portion extending in a direction in which the gap below the exterior panel extends.

* * * * *